United States Patent [19]

Jemison

[11] Patent Number: 5,000,236

[45] Date of Patent: Mar. 19, 1991

[54] TUBE REFILL APPARATUS

[76] Inventor: Jerry M. Jemison, 1227 Martha Allyn St., Saraland, Ala. 36571

[21] Appl. No.: 493,694

[22] Filed: Mar. 15, 1990

[51] Int. Cl.[5] ..... B67C 3/00

[52] U.S. Cl. ..... 141/319; 141/114; 141/89; 141/98; 141/365; 141/368; 15/104.02; 222/81; 220/375; 215/306

[58] Field of Search ..... 141/89, 90, 312, 313, 141/319, 320, 321, 322, 114, 363–365, 366, 368, 369, 370, 98; 215/306; 220/90, 375; 206/219; 15/104.02; 138/103; 222/81, 92, 107, 207, 212, 213, 215, 108, 562, 563

[56] References Cited

U.S. PATENT DOCUMENTS

| | | | |
|---|---|---|---|
| 1,083,327 | 1/1914 | Hopson | 215/306 X |
| 2,533,202 | 12/1950 | Sturtevant | 220/375 X |
| 3,181,725 | 5/1965 | Friedl | 220/375 X |
| 3,216,288 | 11/1965 | Gardner | 15/104.02 X |
| 3,261,381 | 7/1966 | Roach | 141/114 |
| 3,266,533 | 8/1966 | McHale | 141/364 |
| 4,146,152 | 3/1979 | Ogawa et al. | 222/81 |

FOREIGN PATENT DOCUMENTS

| | | | |
|---|---|---|---|
| 1312248 | 11/1962 | France | 215/306 |

*Primary Examiner*—Ernest G. Cusick
*Attorney, Agent, or Firm*—Leon Gilden

[57] ABSTRACT

An apparatus including a through-extending tubular member, including truncated conical end portions internally threaded to accommodate a plurality of tubes at either end thereof to permit a refill of a first tube by a second tube through the conduit. A modification of the instant invention includes a through-extending tube, including a rigid plug mounted thereto. The rigid plug in the preferred embodiment includes a rigid rod mounted thereto to permit directing of the plug through the tube to enable plunging of remaining toothpaste and the like from the tube to a tube to be refilled.

3 Claims, 4 Drawing Sheets

PRIOR ART

FIG 3
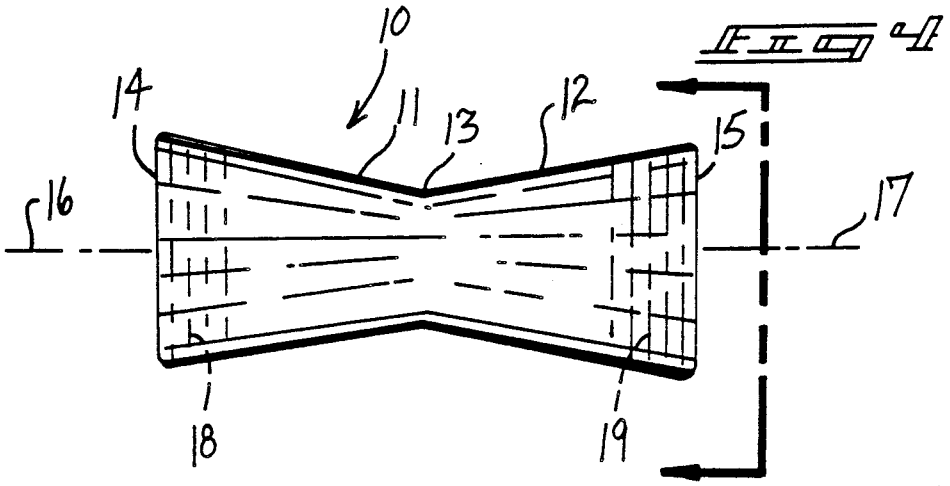
FIG 4
FIG 4
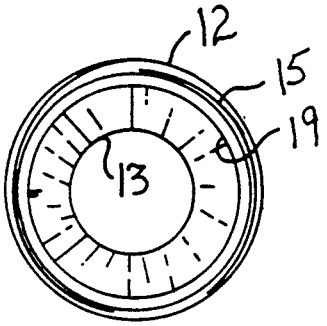

TUBE REFILL APPARATUS

BACKGROUND OF THE INVENTION

1. Field of the Invention

The field of invention relates to tube filling apparatus, and more particularly pertains to a new and improved tube refill apparatus wherein the same permits filling of a first flexible tube by a second flexible tube.

2. Description of the Prior Art

Various filling apparatus is known in the prior art to permit filling of a first container by a second container. Typically such secondary containers are utilized in a smaller configuration for ease of use in camping, traveling, and the like. Examples of the prior art include U.S. Pat. No. 2,737,329 to Bolsey setting forth a filling apparatus for pens, wherein a valving arrangement is secured to a reservoir to permit filling of the pen from the reservoir.

U.S. Pat. No. 2,855,131 to Gewecke, et al., sets forth a bottle filling arrangement wherein a nipple member is associated with a bottle to permit filling of the bottle by a supply source.

U.S. Pat. No. 4,776,495 to Vignot sets forth a dispenser pump to project products in liquid or paste form from a reservoir.

U.S. Pat. No. 2,696,337 to Dinhofer sets forth a means of filling a lady's compact, wherein the compact includes a valve member cooperative with a flexible fill member to permit filling of the compact from a reservoir.

As such, it may be appreciated that there continues to be a need for a new and improved tube refill apparatus wherein the same permits mechanical association of separate flexible paste tubes to permit filling of one tube from the other and in this respect, the present invention substantially fulfills this need.

SUMMARY OF THE INVENTION

In view of the foregoing disadvantages inherent in the known types of fill apparatus now present in the prior art, the present invention provides a tube refill apparatus wherein the same utilizes a coupling conduit to mechanically and fluidly associate spaced and independent flexible paste tubes to permit selective filling of one from the other. As such, the general purpose of the present invention, which will be described subsequently in greater detail, is to provide a new and improved tube refill apparatus which has all the advantages of the prior art fill apparatus and none of the disadvantages.

To attain this, the present invention provides an apparatus including a through-extending tubular member, including truncated conical end portions internally threaded to accommodate a plurality of tubes at either end thereof to permit a refill of a first tube by a second tube through the conduit. A modification of the instant invention includes a through-extending tube, including a rigid plug mounted thereto. The rigid plug in the preferred embodiment includes a rigid rod mounted thereto to permit directing of the plug through the tube to enable plunging of remaining toothpaste and the like from the tube to a tube to be refilled.

My invention resides not in any one of the these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved tube refill apparatus which has all the advantages of the prior art tube refill apparatus and none of the disadvantages.

It is another object of the present invention to provide a new and improved tube refill apparatus which may be easily and efficiently manufactured and marketed.

It is a further object of the present invention to provide a new and improved tube refill apparatus which is of a durable and reliable construction.

An even further object of the present invention is to provide a new and improved tube refill apparatus which is susceptible of a low cost of manufacture with regard to both materials and labor, and which accordingly is then susceptible of low prices of sale to the consuming public, thereby making such tube refill apparatus economically available to the buying public.

Still yet another object of the present invention is to provide a new and improved tube refill apparatus which provides in the apparatuses and methods of the prior art some of the advantages thereof, while simultaneously overcoming some of the disadvantages normally associated therewith.

Still another object of the present invention is to provide a new and improved tube refill apparatus wherein the same utilizes a rigid conduit to mechanically associate independent paste tubes to enable filling of one from the other in a selective manner.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an orthographic side view taken in elevation of the fill apparatus of the instant invention.

FIG. 4 is an orthographic view taken along the lines 4—4 of FIG. 3 in the direction indicated by the arrows.

DESCRIPTION OF THE PREFERRED EMBODIMENT

Figure 1:
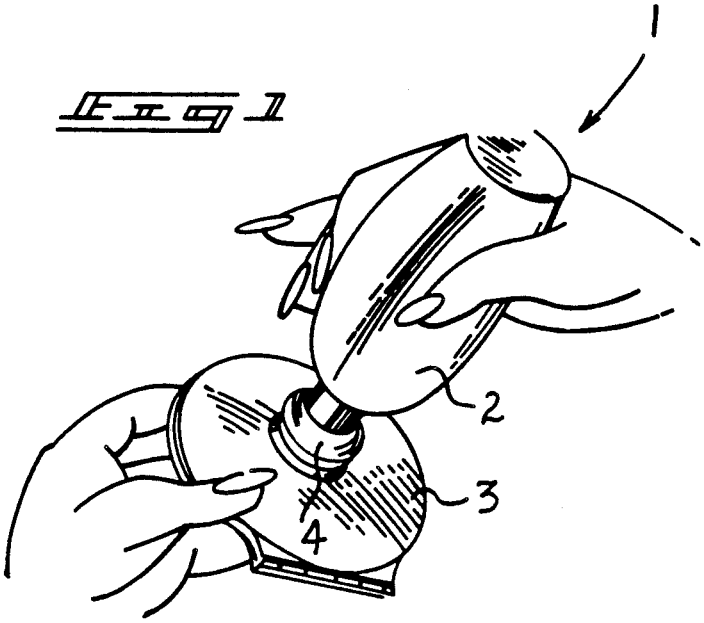
FIG. 1 is an isometric illustration of a prior art filling apparatus.
Figure 2:
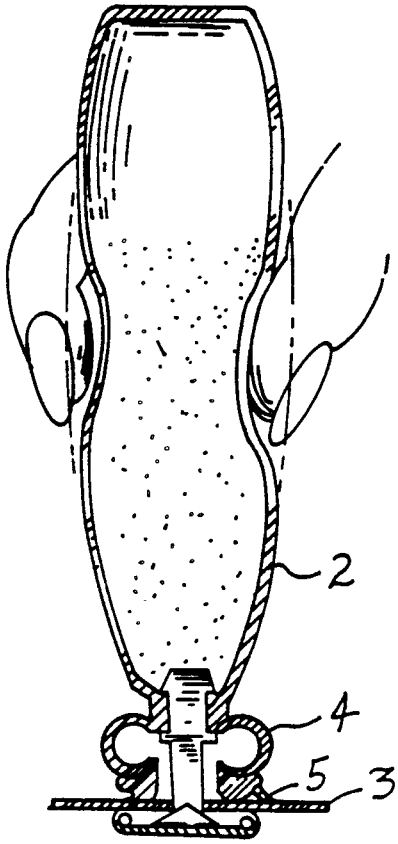
PRIOR ART Fig 2
FIG. 2 is an orthographic cross-sectional view of the prior art fill apparatus as illustrated in FIG. 1.
Figure 5:
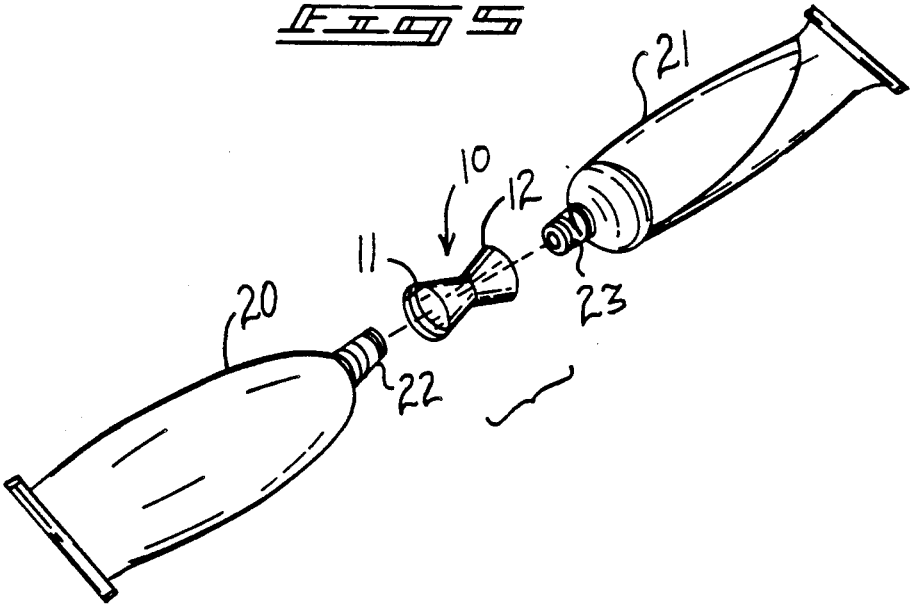
FIG. 5 is an isometric illustration of the instant invention in association with independent paste tubes.

With reference now to the drawings, and in particular to FIGS. 1 to 8 thereof, a new and improved tube refill apparatus embodying the principles and concepts of the present invention and generally designated by the reference numerals 10, 10*a*, and 10*b* will be described.

FIG. 1 illustrates a prior art tube refill apparatus 1, wherein a flexible tube 2 directs its contents selectively to a lady's compact 3 through a valve member 4 associated with with a plug 5 secured to the compact 3.

More specifically, the tube refill apparatus 10 of the instant invention essentially comprises a first head 11 defined by a first axis 16 coaxially aligned and mounted to a second head 12 defined by a second axis 17. The first and second heads 11 and 12 are defined as truncated conical members, with a through-extending passageway therethrough. Each of the respective heads 11 and 12 includes a respective first and second annular entrance 14 and 15, wherein the first annular entrance is defined by a second plane and the second annular entrance is defined by a third plane, wherein a first plane 13 is defined by the intersection and in alignment of the first head 11 with the second head 12. The first, second, and third planes are arranged parallel to one another. The first head 11 includes a first internally threaded portion 18 wherein a second internally threaded portion 19 is formed within the second head 12. In this manner, a first flexible tube 20 (see FIG. 5) is mounted to the first head 11, wherein the first flexible tube 20 includes a first externally threaded nozzle 22 threadedly receivable within the first threaded portion 18. A second flexible tube 21, including a second externally threaded nozzle 23, is received within the second threaded portion 19 to permit fluid communication between the two tubes whereby tube 20 for example may be utilized to fill tube 21. It is understood that the threaded portions 18 and 19 may be of varying diameter and pitch to accommodate variously configured and sized spaced independent tubes 20 and 21.

Figure 6:
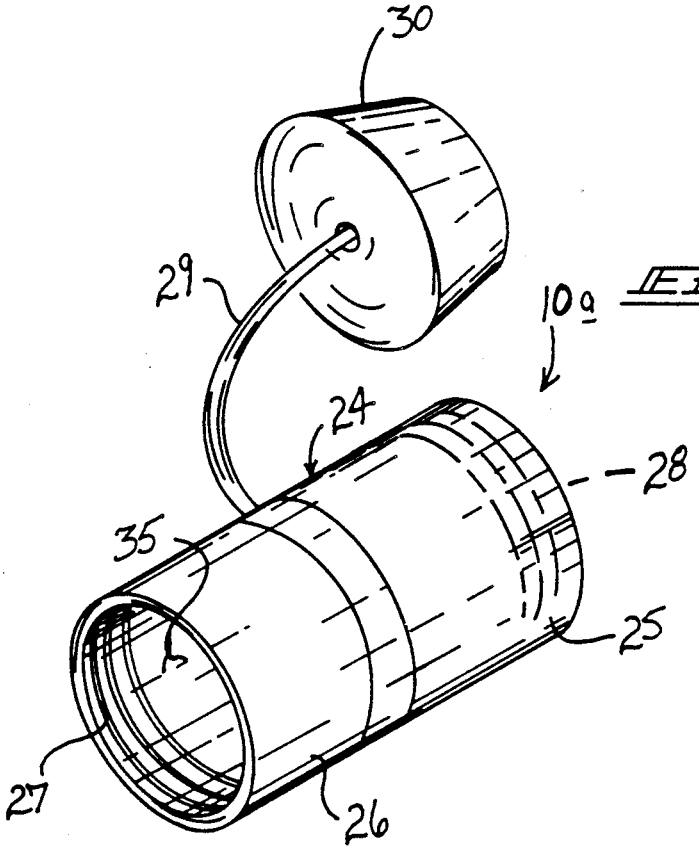
FIG. 6 is an isometric illustration of a modified tube fill apparatus of the instant invention.

FIG. 6 illustrates a modified tube fill apparatus 10*a* wherein a tubular cylindrical body 24 includes a first tubular end 25 and a second tubular end 26, each including and defined by respective annular entrances arranged in planes parallel to one another in a manner as described above. The tubular cylindrical body 24 includes respective first and second internally threaded interior surfaces 27 and 28, with a smooth internal surface 35 coextensive with the internal surface of the cylindrical body 24 between the first and second internal threads 27 and 28. A rigid plug 30 of a generally truncated conical configuration and defined by a plug diameter substantially greater than a predetermined diameter defined by the internal diameter of the cylindrical body 24 is mounted to a first flexible tether line 29. In this manner, (see FIG. 7) the plug 30 may be mounted within the second tubular end 26, while the first tubular end 25 remains in securement about the associated first flexible tube 20 on the first externally threaded nozzle 22 to prevent remaining paste and the like contained within the cylindrical body 24 from dehydrating and permits continuous use of the first tube 20 as a reservoir for replenishment of various secondary flexible paste tubes, in a manner as discussed above.

Figure 8:
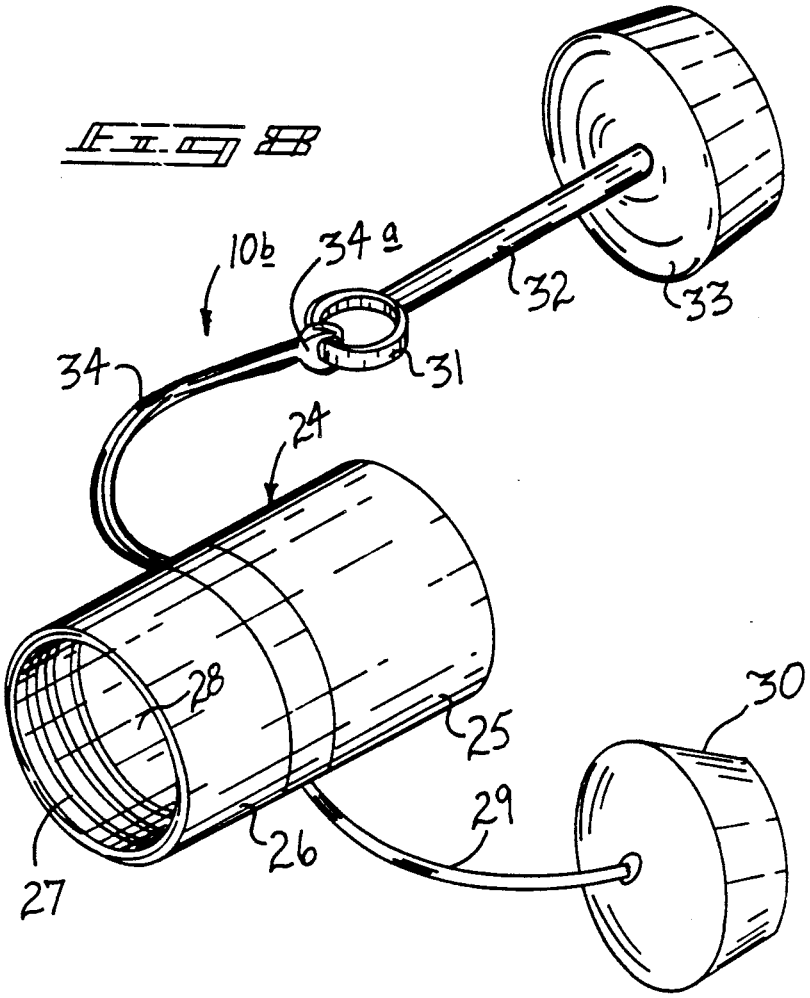
FIG. 8 is an isometric illustration of a yet further modified tube refill apparatus utilized by the instant invention.

FIG. 8 illustrates a further modified tube refill apparatus 10*b* wherein in addition to the rigid plug 30 mounted to the first flexible tether line 29, a further rigid plug 33 is defined by a rigid plug diameter substantially equal to the predetermined diameter defined by the internal diameter of the tubular cylindrical body 24. A plunger rod 32 is orthogonally and coaxially aligned and extends outwardly from the further rigid plug 33 and terminates at its free end with a ring 31. A second tether line 34 secures the cylindrical body 24 to the ring 31 by use of a loop 34*a* that is slidably mounted about the ring 31 to permit repositionment of the loop 34*a* relative to the ring 31 during a plunging procedure. The plunging procedure includes a manner of evacuating remaining paste contained and residing within the cylindrical body 24 subsequent to its use, wherein the further rigid plug 33 is directed through the cylindrical body 24 to remove residual paste remaining within the cylindrical body and assist in the maintenance and cleaning of the cylindrical body during periods of use.

Figure 7:
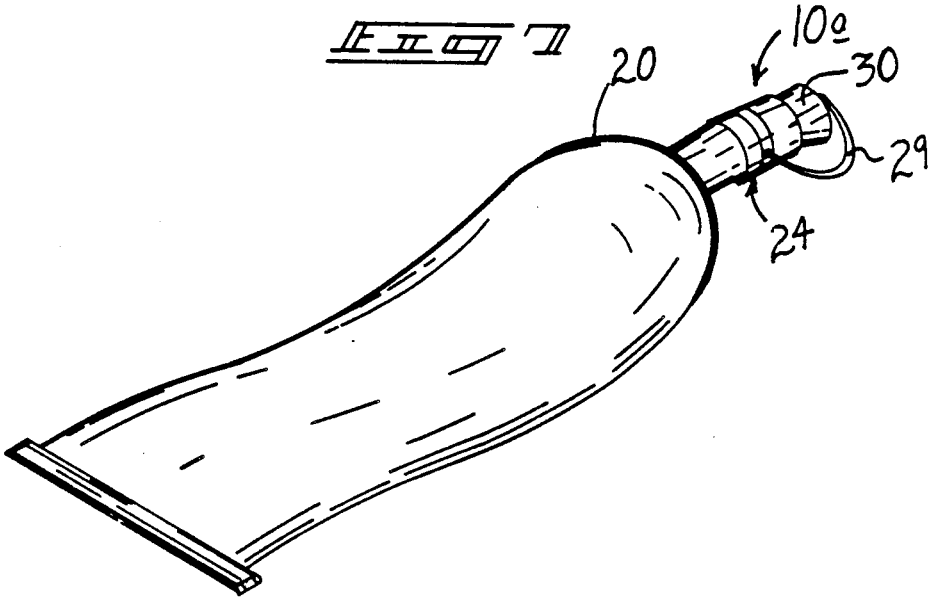
FIG. 7 is an isometric illustration of the modified fill apparatus of FIG. 6 mounted to an associated paste tube.

It is understood that the length of the rigid rod 32 is substantially greater than that of an axial length defined by the cylindrical body 24 to permit a complete directing of the second rigid plug 33 through the complete interior surface of the cylindrical body 24. Subsequently, the first rigid plug 30 may be mounted to an available entrance of the cylindrical body 24 when the cylindrical body is mounted to an associated toothpaste tube in a manner as illustrated in FIG. 7.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A tube refill apparatus adapted to provide fluid communication between a first flexible tube and a second flexible tube, wherein the first flexible tube includes a first externally threaded nozzle and the second flexible tube includes a second externally threaded nozzle, wherein the apparatus comprises, an elongate body member, the body member including a first head and a second head, the first head in fluid communication with the second head, and the first head including first internal threads and the second head including second internal threads, and a smooth interior surface defined between the first internal threads and the second internal threads, and the first head including a first annular opening, and the second head including a second annular opening, wherein the first annular opening and the second annular opening are coaxially aligned relative to one another, and the first annular opening is defined within a first plane and the second annular opening is defined within a second plane, and the first head and the second head are secured to one another by an intersection annulus defined by a third plane, wherein the first plane, the second plane, and the third plane are parallel to one another, and the first internal threads adapted to threadedly receive the first externally threaded nozzle, and the second internal threads adapted to threadedly receive the second externally threaded nozzle, and wherein the first head and second head are coaxially aligned relative to one another and defined by a single elongate tubular cylindrical body, and including a first rigid plug integrally secured to a first flexible tether line, the first flexible tether line including a first end integrally secured to the first rigid plug, and a second end rigidly secured to an exterior surface of the cylindrical body, and wherein the first rigid plug is defined by a first plug diameter, and the first annular opening and the second annular opening of the cylindrical body includes an internal diameter defined by a predetermined diameter, wherein the predetermined diameter is substantially less than the first diameter, and including a second flexible tether line, wherein the second flexible tether line is fixedly mounted to the cylindrical body at one end and terminates in a loop at a second end, and the loop slidably mounted about a rigid ring, the rigid ring integrally secured to a rigid elongate rod, and the elongate rod orthogonally and integrally mounted to a second rigid plug.

2. An apparatus as set forth in claim 1 wherein the second rigid plug is defined by a second rigid plug diameter substantially equal to the predetermined diameter of the cylindrical body to permit plunging of the cylindrical body by the second rigid plug enabling cleaning of the cylindrical body by the second rigid plug.

3. An apparatus as set forth in claim 2 wherein the rigid rod is defined by a predetermined length and the cylindrical body is defined by a predetermined axial length, wherein the predetermined length is substantially greater than the axial length.

* * * * *